United States Patent [19]

Soliman et al.

[11] Patent Number: 5,005,643

[45] Date of Patent: Apr. 9, 1991

[54] METHOD OF DETERMINING FRACTURE PARAMETERS FOR HETEROGENOUS FORMATIONS

[75] Inventors: Mohamed Y. Soliman, Lawton; Robert D. Kuhlman; Don K. Poulsen, both of Duncan, all of Okla.

[73] Assignee: Halliburton Company, Duncan, Okla.

[21] Appl. No.: 522,427

[22] Filed: May 11, 1990

[51] Int. Cl.[5] ..... E21B 43/26; E21B 47/06

[52] U.S. Cl. ..... 166/250; 166/308; 73/155

[58] Field of Search ..... 166/250, 308; 73/155

[56] References Cited

U.S. PATENT DOCUMENTS 4,398,416 8/1983 Nolte ..... 73/155
4,749,038 6/1988 Shelley ..... 166/250
4,797,821 11/1989 Petak et al. ..... 73/155 X
4,836,280 6/1989 Soliman ..... 73/155 X
4,848,461 7/1989 Lee ..... 166/250

OTHER PUBLICATIONS

SPE 15151-R. F. Shelley and J. M. McGowen-Halliburton Services *Pump-In Test Correlation Predicts Proppant Placement*, 1986.

*Primary Examiner*—George A. Suchfield
*Attorney, Agent, or Firm*—Robert A. Kent

[57] ABSTRACT

A method of determining fracture parameters for heterogeneous formations is provided based upon pressure decline measurements from minifrac tests. The inventions provide methods for generating type curves for heterogeneous formations, as well as a leak-off exponent that characterizes specific fracturing fluid/formation systems.

7 Claims, 9 Drawing Sheets

*Pressure Decline vs Time*

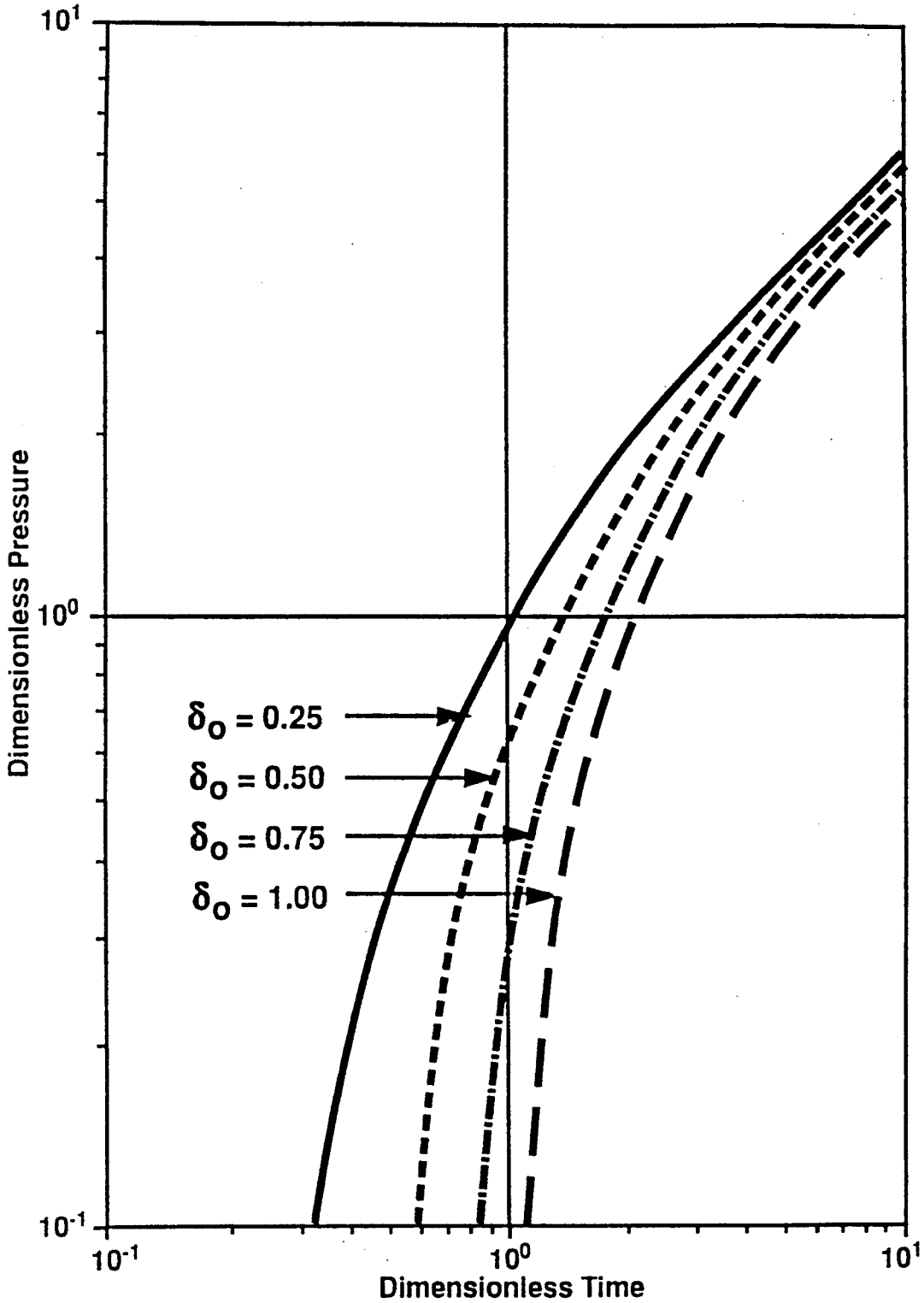
*Fig. 1-Type Curve for Leakoff Exponent = 0.50*

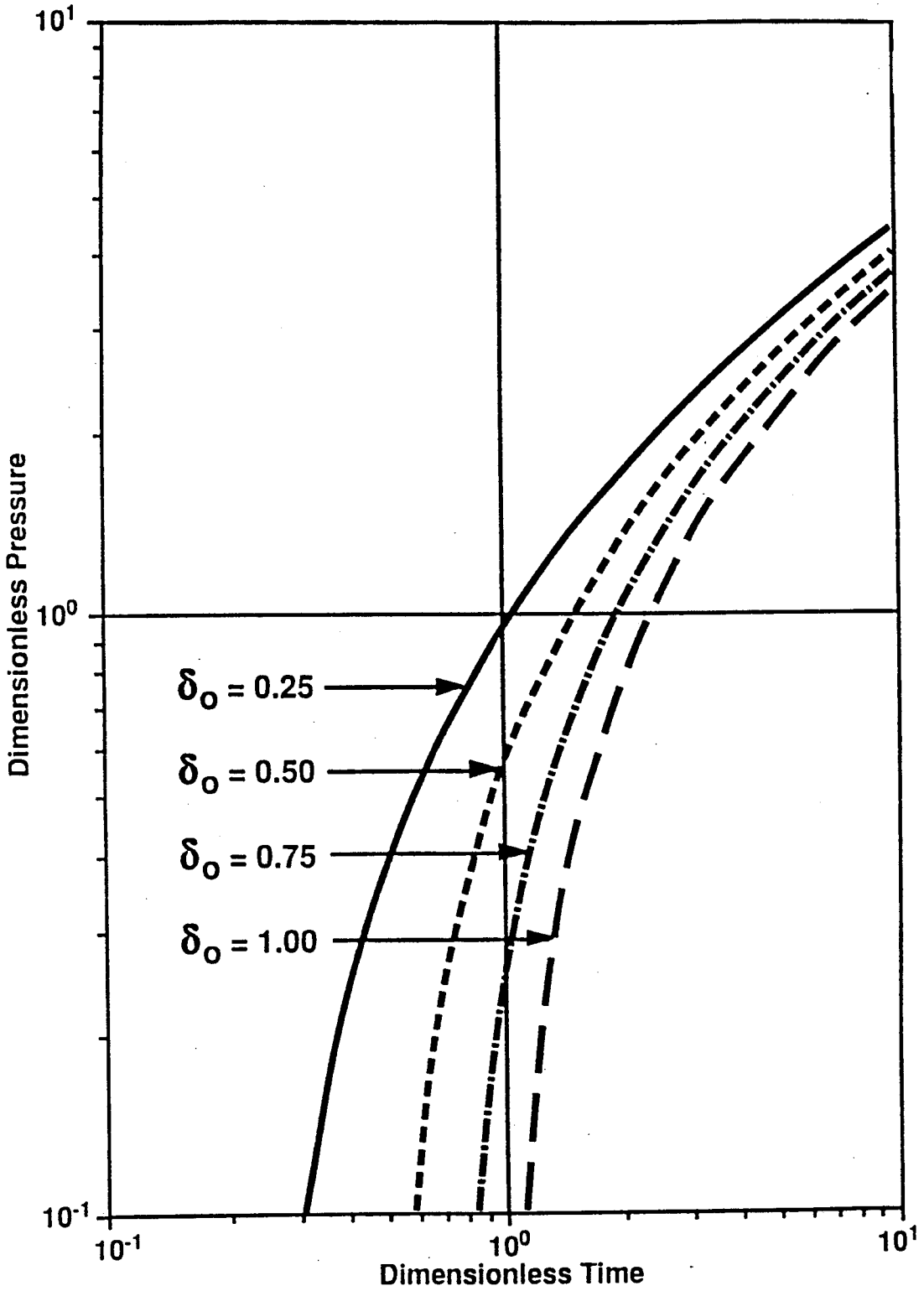
*Fig. 2-Type Curve for Leak-off Exponent = 0.75*

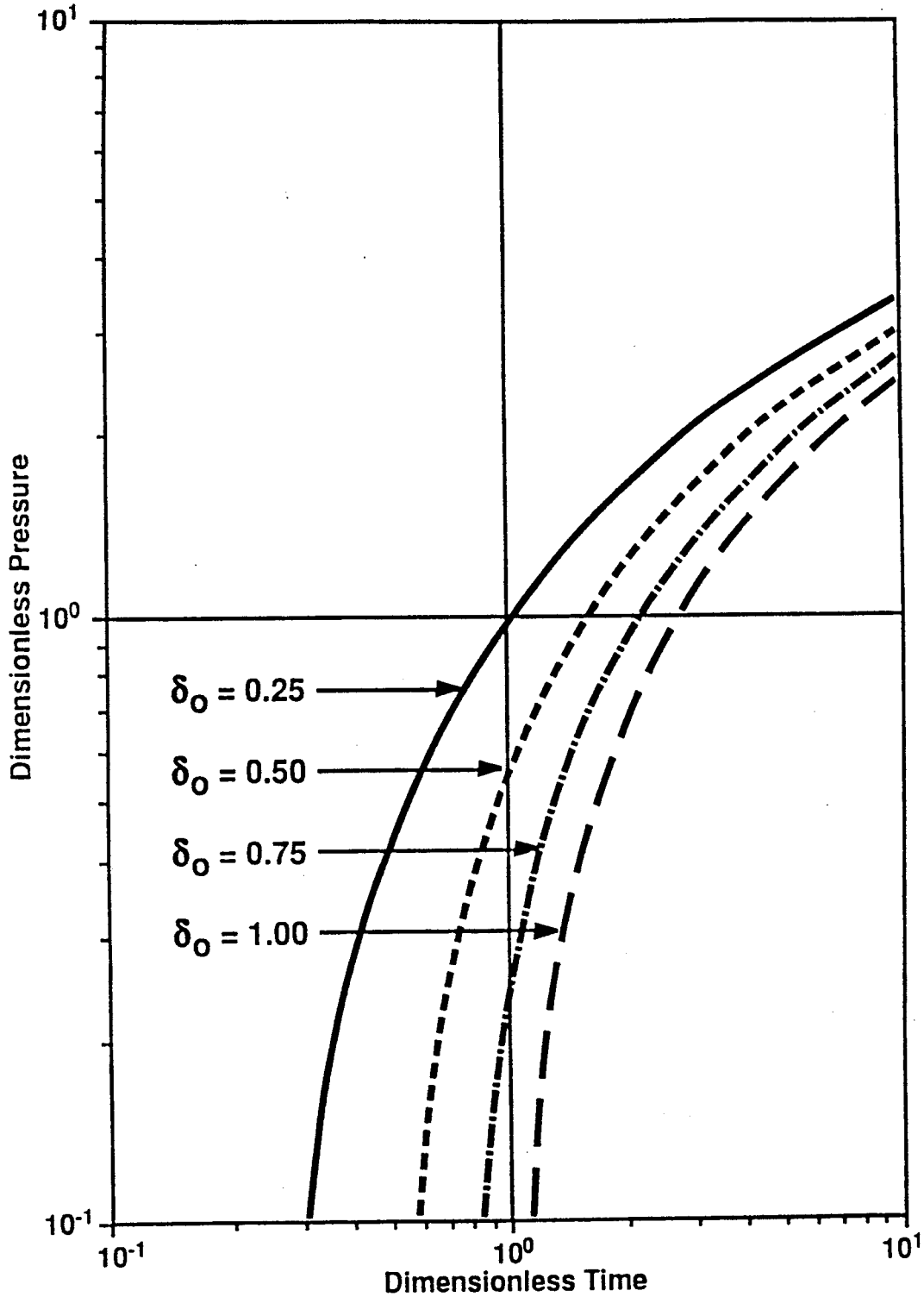
*Fig. 3-Type Curve for Leak-off Exponent = 1.00*

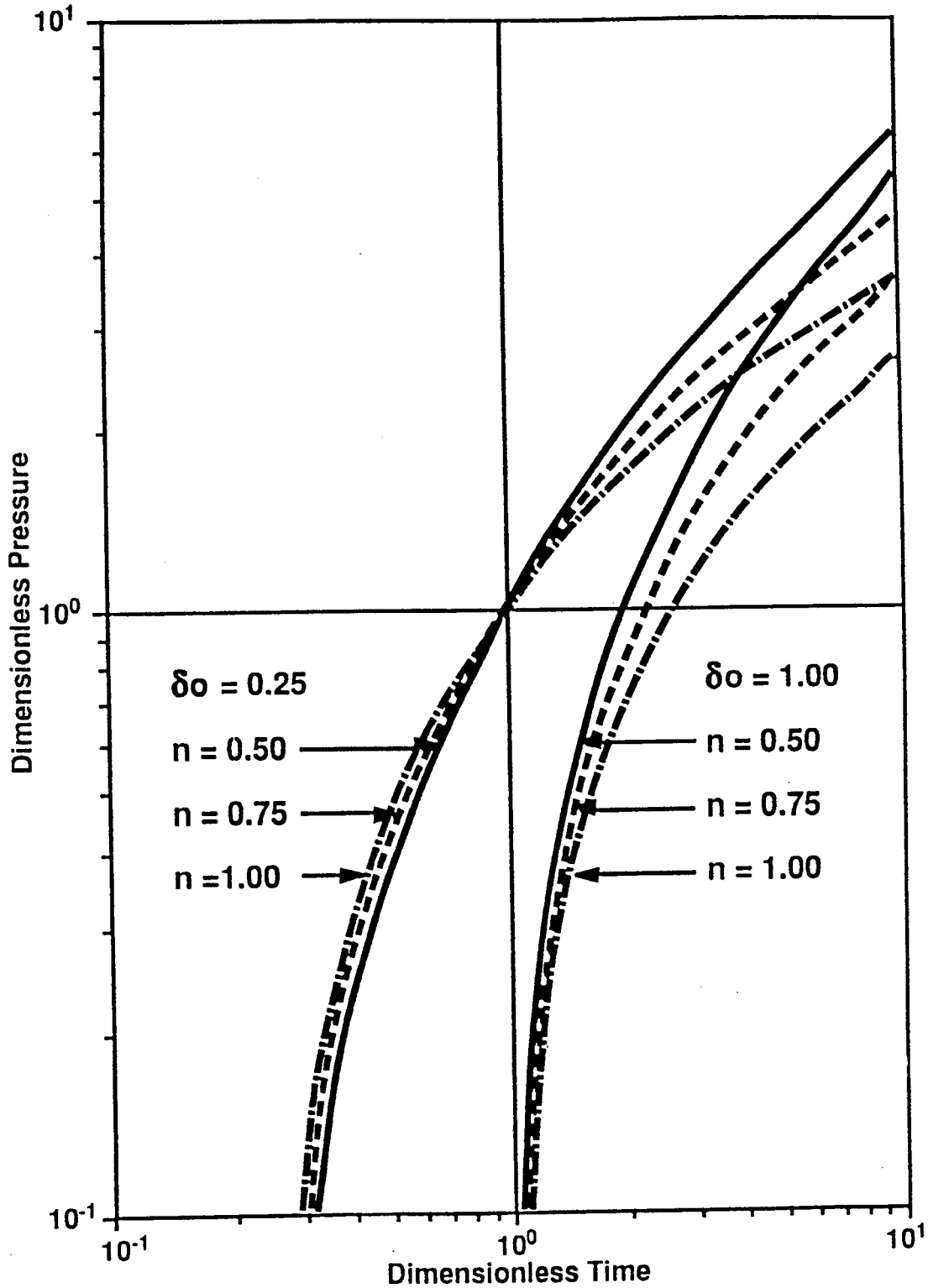
*Fig. 4-Comparison of Type Curves*

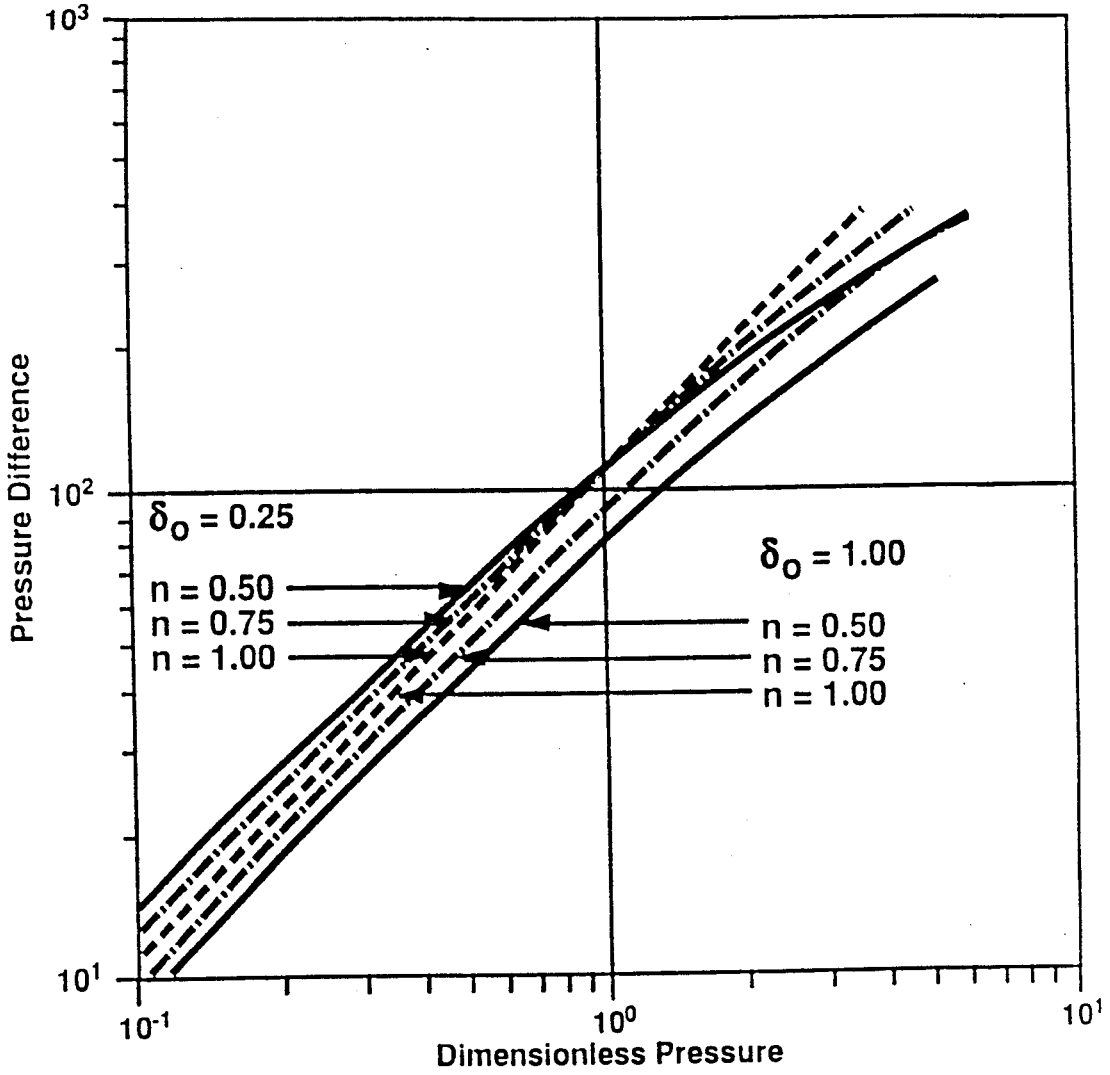
*Fig. 5 -Pressure Difference vs Dimensionless Pressure*

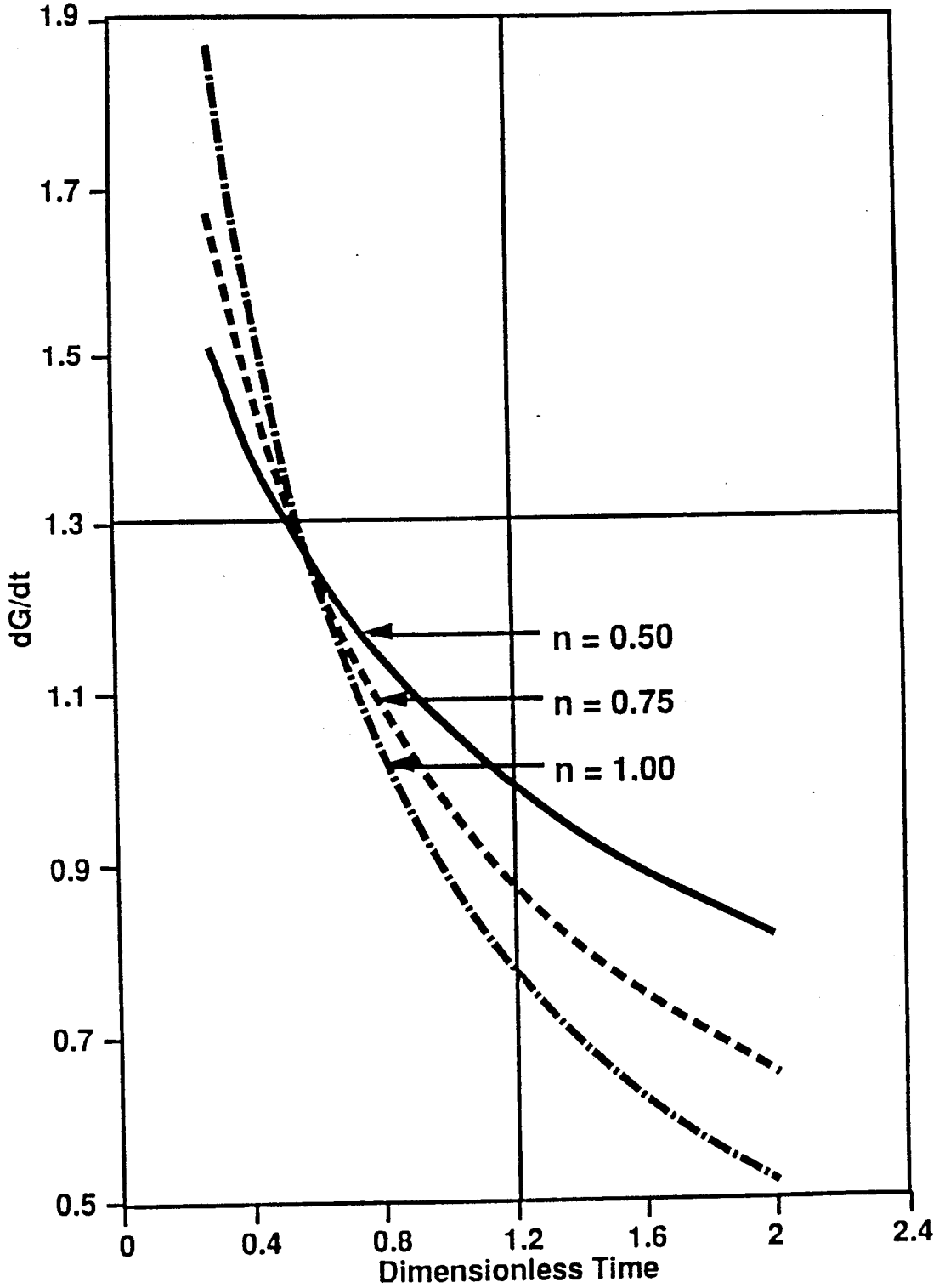
*Fig. 6-Derivative of Dimensionless Pressure*

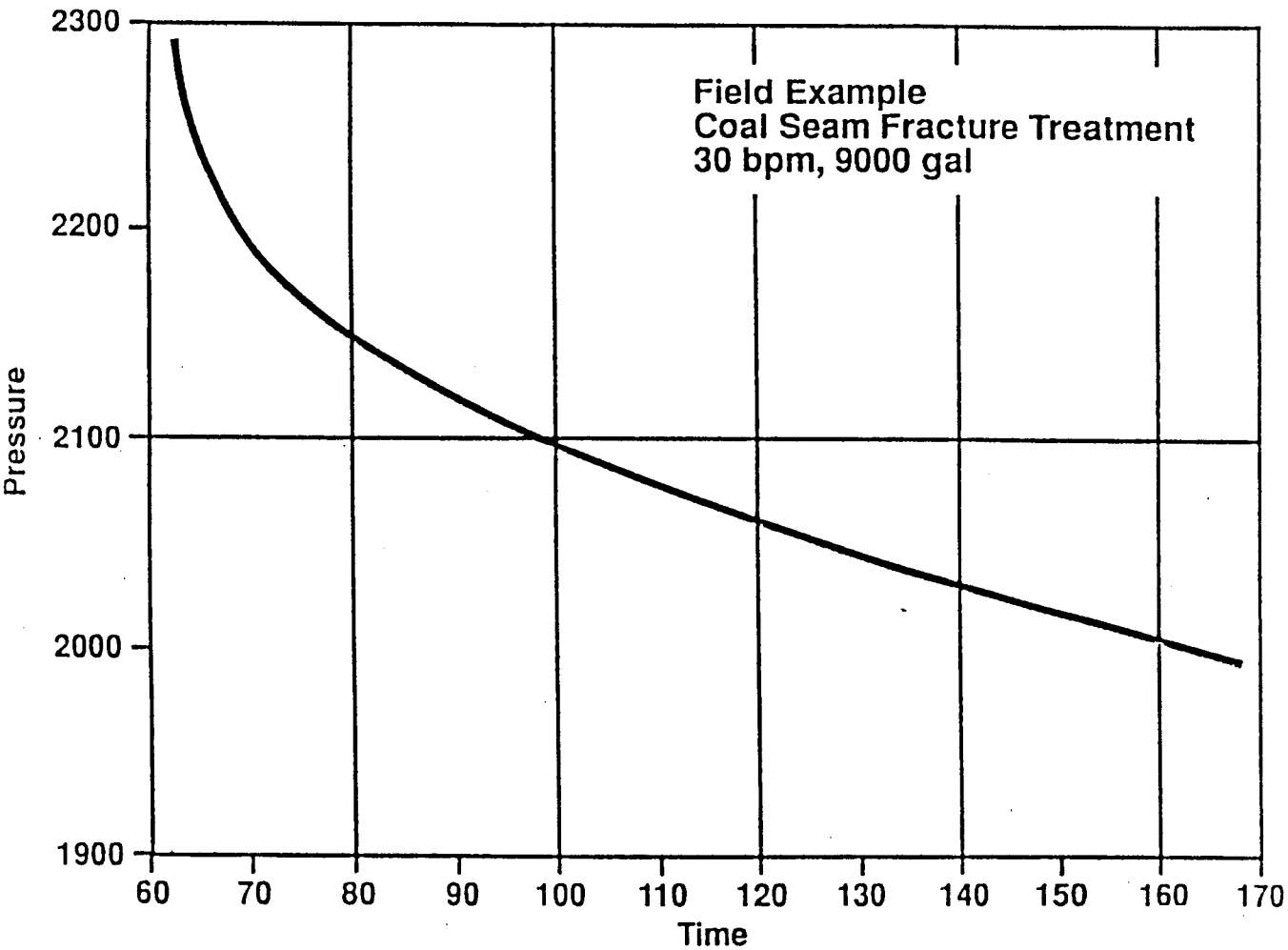
*Fig. 7-Pressure Decline vs Time*

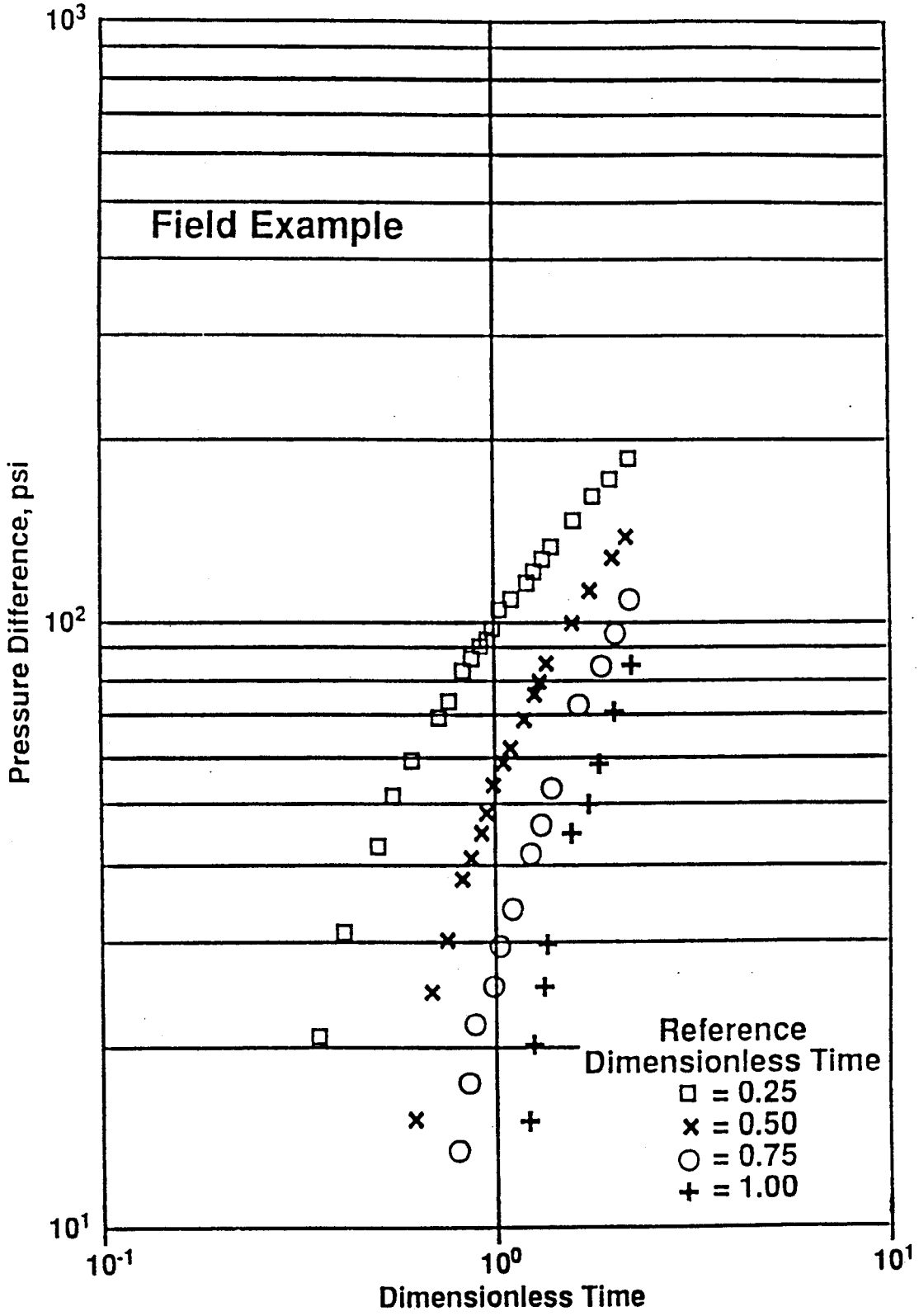
*Fig.* 8

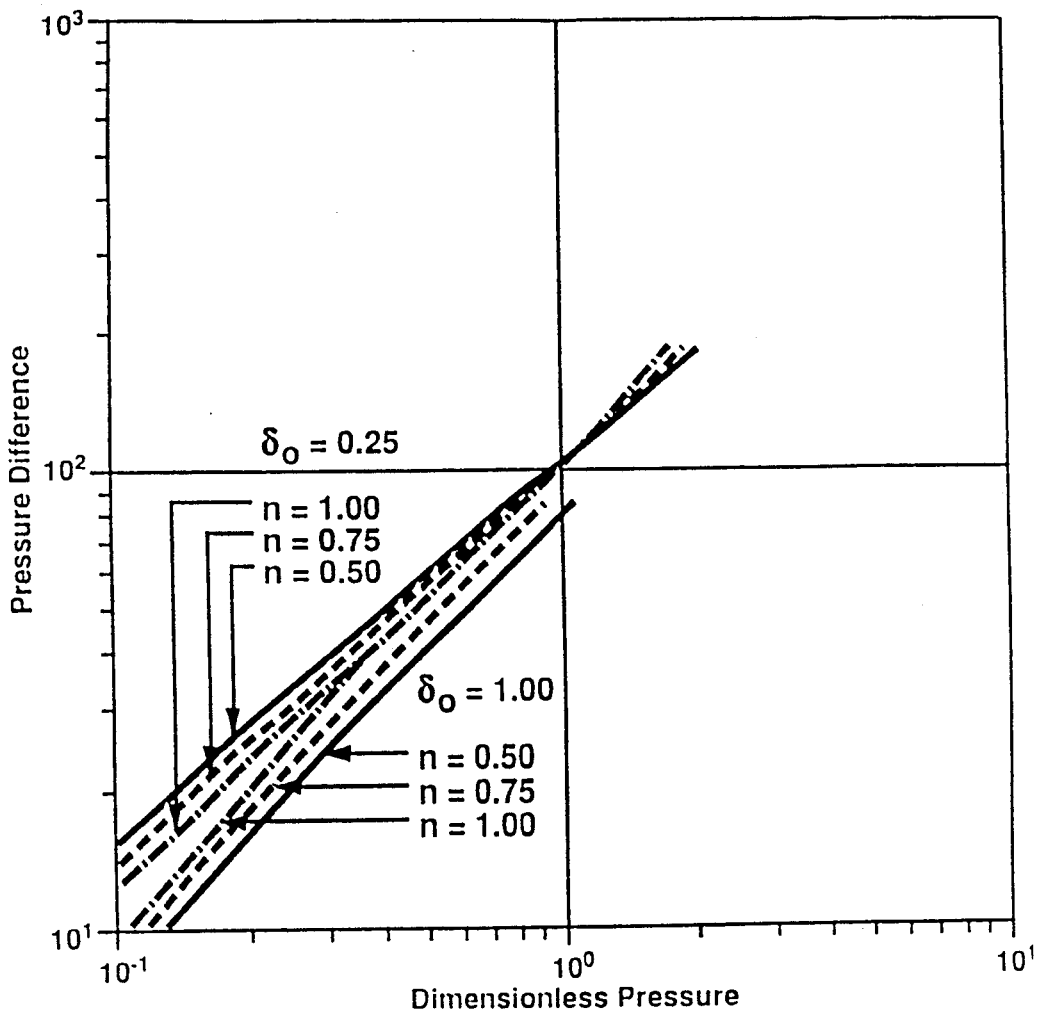
*Fig. 9 -Pressure Difference vs Dimensionless Pressure*

METHOD OF DETERMINING FRACTURE PARAMETERS FOR HETEROGENOUS FORMATIONS

BACKGROUND OF THE INVENTION

The present invention relates generally to improved methods for evaluating subsurface fracture parameters in conjunction with the hydraulic fracturing of subterranean formations and more specifically relates to improved methods for utilizing test fracture operations and analysis, commonly known as "minifrac" operations, to design formation fracturing treatments.

A minifrac operation is performed to obtain information about the subterranean formation surrounding the well bore. Minifrac operations consist of performing small scale fracturing operations utilizing a small quantity of fluid to create a test fracture and then monitor the formation response by pressure measurements. Minifrac operations are normally performed using little or no proppant in the fracturing fluid. After the fracturing fluid is injected and the formation is fractured, the well is shut-in and the pressure decline of the fluid in the newly formed fracture is observed as a function of time. The data thus obtained are used to determine parameters for designing the full scale formation fracturing treatment. Conducting minifrac tests before performing the full scale treatment generally results in enhanced fracture designs and a better understanding of the formation characteristics.

Minifrac test operations are significantly different from conventional full scale fracturing operations. For example, as discussed above, typically a small amount of fracturing fluid is injected, and no proppant is utilized in most cases. The fracturing fluid used for the minifrac test is normally the same type of fluid that will be used for the full scale treatment. The desired result is not a propped fracture of practical value, but a small scale fracture to facilitate collection of pressure data from which formation and fracture parameters can be estimated. The pressure decline data will be utilized to calculate the effective fluid-loss coefficient of the fracturing fluid, fracture width, fracture length, efficiency of the fracturing fluid, and the fracture closure time. These parameters are then utilized in a fracture design simulator to establish parameters for performing a full scale fracturing operation.

Accurate knowledge of the fluid-loss coefficient from minifrac analysis is of major importance in designing a fracturing treatment. If the loss coefficient is estimated too low, there is a substantial likelihood of a sand out. Conversely, if the fluid leak-off coefficient is estimated too high, too great a fluid pad volume will be utilized, thus resulting in significantly increased cost of the fracturing operation and may often cause unwarranted damage to the formation.

Conventional methods of minifrac analysis are well known in the art and have required reliance upon various assumptions, some of which are of questionable validity. Current minifrac models assume that fluid-loss or leak-off rate is inversely proportional to the square root of contact time, which indicates that the formation is assumed to be homogeneous and that back pressure in the formation builds up with time, thus resisting fluid flow into the formation. In the conventional minifrac analysis as described in U.S. Pat. No. 4,398,416 to Nolte, the pressure decline function, G, is always determined using this assumption. However not all formation/fluid systems have a leak-off rate inversely proportional to the square root of time.

As stated above, in conventional minifrac analysis the formation is presumed to be homogeneous. Consequently, the derived equations of conventional minifrac analysis do not accurately apply to heterogeneous formations, e.g., naturally fractured formations. A naturally fractured formation contains highly conductive channels which intersect the propagating fracture. In a naturally fractured formation, fluid-loss occurs very rapidly due to the increased formation surface area. Consequently, depending on the number of natural fractures that intersect the propagating fracture, the fluid loss rate will vary as a function of time raised to some exponent.

In Paper 15151 of the Society of Petroleum Engineers and U.S. Pat. No. 4,749,038, Shelley and McGowen recognized that conventional minifrac analysis techniques when applied to naturally fractured formations failed to adequately predict formation behavior. Shelley and McGowen derived an empirical correlation for various naturally fractured formations based on several field cases. However, such empirical correlations are strictly limited to the formations for which they are developed.

The present invention provides modifications to minifrac analysis techniques which makes minifrac analysis applicable to all types of formations, including naturally fractured formations, without the need for specific empirical correlations. The present invention also introduces a new parameter, the leak-off exponent, that characterizes fracturing fluid and formation systems with respect to fluid loss.

SUMMARY OF THE INVENTION

The present invention provides a method for accurately assessing fluid-loss properties of fracturing fluid/formation systems and particularly fluids in heterogeneous subterranean formations. The present method comprises the steps of injecting the selected fracturing fluid to create a fracture in the subterranean formation; matching the pressure decline in the fluid after injection to novel type curves in which the pressure decline function, G, is evaluated with respect to a leak-off exponent; and determining other fracture and formation parameters. In another embodiment of the present invention, the leak-off exponent that characterizes the fluid/formation system is determined by evaluating log pressure difference versus log dimensionless pressure. In accordance with the present invention, the leak-off exponent provides an improved method for designing full scale fracture treatments.

BRIEF DESCRIPTION OF THE DRAWINGS

FIG. 1 is a graph of the log of dimensionless pressure function, G, versus the log of dimensionless time for dimensionless reference times of 0.25, 0.50, 0.75, and 1.00 where the leak-off exponent (n) is equal to 0.5.

FIG. 2 is a graph of the log of dimensionless pressure function (G) versus the log of dimensionless time for dimensionless reference times of 0.25, 0.50, 0.75, and 1.00 where the leak-off exponent (n) is equal to 0.75.

FIG. 3 is a graph of the log of dimensionless pressure function (G) versus the log of dimensionless time for dimensionless reference times of 0.25, 0.50, 0.75, and 1.00 where the leak-off exponent (n) is equal to 1.00.

FIG. 4 is a graph of the log of dimensionless pressure function (G) versus the log of dimensionless time for dimensionless reference times equal to 0.25 and 1.00 in which the type curves for various values of the leak-off exponent (n) are shown.

FIG. 5 is a graph of the log of pressure difference versus the log of dimensionless pressure for computer simulated data for dimensionless reference times of 0.25 and 1.00.

FIG. 6 is a graph of the derivative of dimensionless pressure versus dimensionless time for different values of the leak-off exponent (n).

FIG. 7 is a graph of the measured pressure decline versus shut-in time for a coal seam fracture treatment.

FIG. 8 is a graph of the log of pressure difference versus the log of dimensionless time for dimensionless reference times of 0.25, 0.50, 0.75, and 1.00 for the coal seam fracture treatment.

FIG. 9 is a graph of the log of pressure difference versus the log of dimensionless pressure for dimensionless reference times of 0.25 and 1.00 for various values of the leak-off exponent (n).

DETAILED DESCRIPTION OF THE PREFERRED EMBODIMENT

Methods in accordance with the present invention assist the designing of a formation fracturing operation or treatment. This is preferably accomplished through the use of a minifrac test performed a few hours to several days prior to the main fracturing treatment. As noted above, the objectives of a minifrac test are to gain knowledge of the fracturing fluid loss into the formation and fracture geometry. For design purposes, the most important parameter calculated from a minifrac test is the leak-off coefficient. Fracture length and width, fluid efficiency, and closure time may also be calculated. The minifrac analysis techniques disclosed herein are suitable for application with well known fracture geometry models, such as the Khristianovic-Zheltov model, the Perkins-Kern model, and the radial fracture model as well as modified versions of the models. In a preferred implementation, the fracturing treatment parameters, formation parameters, and fracturing fluid parameters not empirically determined will be determined mathematically, through use of an appropriately programmed computer.

In accordance with the present invention, the formation data will be obtained from the minifrac test operation. This test fracturing operation may be performed in a conventional manner to provide measurements of fluid pressure as a function of time. As is well known in the art, the results of the minifrac test can be plotted as log of pressure difference versus log of dimensionless time. Having plotted log of pressure difference versus log of dimensionless time, the fracture treatment parameters can be determined using a "type curve" matching process.

Conventional type curves have been developed by Nolte and others for use with the various fracture geometry models. These type curves assume that the apparent fluid-loss velocity from the fracture at a given position may be calculated according to the following equation:

$$v = \frac{C_{eff}}{(\Delta t)^{0.5}} \qquad \text{EQN. (1)}$$

where $\Delta t$ = contact time between the fluid and the fracture face at a given position, minutes, $C_{eff}$ = effective fluid loss coefficient, ft/min$^{0.5}$ Using this assumption, the conventional "type curve" for the Perkins and Kern model is generated according to the following equations:

$$G(\delta,\delta_o) = \frac{4}{\pi}\,[g(\delta) - g(\delta_o)] \qquad \text{EQN. (2)}$$

where

G = dimensionless pressure difference function g = average decline rate function $$g(\delta) = 4/3[(1+\delta)^{3/2} - \delta^{3/2} - 1] \qquad \text{EQN. (3)}$$

where $\delta_o$ = dimensionless reference shut-in time; and $\delta$ = dimensionless shut-in time In evaluating the dimensionless pressure decline function $G(\delta,\delta_o)$ by conventional methods, the exponent of contact time in Eqn. (1) is always 0.5, regardless of the formation-fluid system. Using Eqns. (2) and (3) above, $G(\delta,\delta_o)$ is calculated for selected dimensionless times. Various values of $\delta_o$ are inserted into Eqn. (3) to determine a $g(\delta_o)$ value. Another value for $\delta$ is selected which is greater than $\delta_o$ and substituted into Eqn. (3) to calculate $g(\delta)$. Eqn. (2) is then used to calculate $G(\delta,\delta_o)$. This process is repeated for additional values of $\delta$ and $\delta_o$. The calculated $G(\delta,\delta_o)$ values are then plotted on a log-log scale against dimensionless time ($\delta$) to form the "type curves." Conventionally, $G(\delta,\delta_o)$ is evaluated for $\delta_o$ equal to 0.25, 0.50, 0.75, and 1.0.

The next step in conventional minifrac analysis is plotting on a log-log scale the field data in terms of $\Delta P(\delta,\delta_o)$ for $\delta_o$ corresponding to 0.25, 0.50, 0.75, and 1.00 versus dimensionless time. The type curve is overlain the field data matching the vertical axis for $\delta=1$ with the pump time ($t_o$) of the field data. The value of $\Delta P$ from the field data which corresponds to $G(\delta,\delta_o)=1$ is the match pressure, P*.

Having determined P* from the curve matching process, a value for the effective fluid-loss coefficient, $C_{eff}$, can be determined from the following equation:

$$C_{eff} = \frac{P \cdot H^2 \beta_s}{H_p E'(t_o)^{.5}} \qquad \text{EQN. (4)}$$

Where $C_{eff}$ = effective fluid-loss coefficient, ft/min$^{0.5}$ $H_p$ = fluid-loss height, ft $E'$ = plane strain modulus of the formation, psi $t_o$ = pump time, min H = gross fracture height, ft $\beta_s$ = ratio of average and well bore pressure while shut-in Once the effective fluid-loss coefficient ($C_{eff}$) is determined from the above equation the remaining formation parameters such as fluid efficiency (n), fracture length (L) and fracture width (w) can be determined using established equations.

As illustrated above, conventional minifrac analysis assumes that fracturing fluid leak-off coefficient is inversely proportional to the square root of pumping time, i.e., $C_{eff} \propto 1/(t_o)^5$. Such a relationship indicates that the formation is assumed to be homogeneous, that back pressure in the formation builds up with time thus resisting flow into the formation, and that a filter cake, if present, may be building up with time. However, the observation has been made that when the formation is heterogeneous, or naturally fractured, the leak-off rate as a function of time may follow a much different relationship than that of Eqn. (1). A naturally fractured formation should yield a leak-off exponent of less than 0.5 and in many cases may approach 0.0. If the leak-off exponent approaches 0.0, the leak-off rate is independent of time, thus leading to a higher than expected leak-off volume during the main stimulation treatment.

If the conductivity of the natural fractures is extremely high, the effect of a back pressure in the formation will be insignificant during the minifrac test. Under this circumstance, the exponent of contact time $(\Delta t)^n$ would be expected to be close to 0.0, which indicates that leak-off rate per unit area of the fracture face is nearly constant. If, however, an efficient filter cake is formed by the fracturing fluid, the time exponent may approach 0.5 or even be greater than 0.5. As known to those skilled in the art not all fracturing fluids leak-off at the same rate in the same reservoir. Depending on the reservoirs geological characteristics, a water-based, hydrocarbon base, or foam fracturing fluid may be required. Each of these fluids have different leak-off characteristics. The amount of leak-off can also be controlled to a certain extent with the addition of various additives to the fluid.

Accordingly, depending on the natural fracture conductivity and fracturing fluid behavior, the time exponent can range between 0.0 and 1.0. When pressure data are collected from a formation which is heterogeneous, e.g., naturally fractured or when the formation/fluid system yields $n \neq 0.5$, and plotted as discussed above, those data will have a poor or no match with the conventional type curves because the fluid leak-off rate is not inversely proportional to the square root of contact time. The present invention provides a method of generating new type curves which are applicable to all types of formations including naturally fractured formations and a new parameter, the leak-off exponent, that characterizes the fluid/formation leak-off relation.

In developing the present invention, the following general assumptions have been made: (1) the fracturing fluid is injected at a constant rate during the minifrac test; (2) the fracture closes without significant interference from the proppant, if present; and (3) the formation is heterogeneous such that back pressure resistance to flow may deviate from established theory. Using the above assumptions and equations developed for minifrac tests, new type curves for pressure decline analysis for heterogeneous formations have been developed. The new type curves of the present invention are functions of dimensionless time, dimensionless reference times, and a leak-off exponent (n).

The set of type curves generated in accordance with the present invention that gives the best match to field data will yield both the fluid-loss coefficient ($C_{eff}$) and a leak-off exponent (n) characterizing the formation.

The following equations define the new type curves:

$$G(\delta,\delta_o,n) = \frac{4}{\pi}\,[g(\delta,n) - g(\delta_o,n)] \qquad \text{EQN. (5)}$$

-continued $$= \frac{4}{\pi}\,\frac{1}{(1-n)(2-n)}\,[(1+\delta)^{2-n} - \delta^{2-n} - (1+\delta_o)^{2-n} + \delta_o^{2-n}] \qquad \text{EQN. (6)}$$

where the leak-off exponent (n) is not equal to 1; and $$G(\delta,\delta_o,n) = \frac{4}{\pi}\left[\delta \ln\left(\frac{1+\delta}{\delta}\right) + \ln(1+\delta) - \delta_o \ln\left(\frac{1+\delta_o}{\delta_o}\right) - \ln(1+\delta_o)\right] \qquad \text{EQN. (7)}$$

where the leak-off exponent (n) is equal to 1.

The type curves of this invention are generated in a similar manner as conventional type curves to the extent that values of $\delta$ and $\delta_o$ are selected for evaluating G. However, instead of the exponent always being 0.5 as in Eqn. (1), the exponent is "n" and can be any value between 0.0 and 1.0. In performing the method of the present invention, the value of n must be determined.

The value of the leak-off exponent (n) can be determined in a number of ways. One method is to prepare numerous type curves for values of n ranging from 0.0 to 1.0. Substituting various n values, e.g. 0.0, 0.05, 0.10 . . . , in Eqn. (6) (or using Eqn. (7) for n=1) and selecting values for $\delta_o$ and $\delta$, many type curves can be produced. The resulting dimensionless pressure function, $G(\delta,\delta_o,n)$, and dimensionless time values are plotted on a log-log coordinate system. Each type curve will conventionally have dimensionless reference times ($\delta_o$) of 0.25, 0.50, 0.75, and 1.00; however, other reference times may be used. FIGS. 1, 2, and 3 show type curves generated in accordance with the present invention for n values of 0.50, 0.75, and 1.0. FIGS. 1–3 indicate that the shape of the type curves for various leak-off exponents is similar; however, as the exponent gets larger, the type curves will show higher curvature. FIG. 4 shows a comparison of type curves for dimensionless reference times of 0.25 and 1.0. Noting that where n=0.5 is equivalent to conventional minifrac analysis, FIG. 4 demonstrates the significant deviation from the original type curve when the leak-off exponent is greater than 0.5.

To determine the proper n value for the pressure versus time data of a given field treatment, the field data are plotted as log of pressure difference ($\Delta P$) versus log of dimensionless time ($\delta$) and matched to the type curves generated for various leak-off exponents. The type curve that matches the field data most exactly is selected as the master type curve. The value of n for the selected type curve is the leak-off exponent for this particular fracturing treatment and formation system. In the next step, the value of $\Delta P$ on the graph of the field data is selected that corresponds to the point of the correct master type curve where $G(\delta,\delta_o,n)$ equals 1. That point is the match pressure ($P^*$).

Using the leak-off exponent and the particular fracture geometry model chosen by the operator, the appropriate set of equations are then used to calculate the fluid-loss coefficient ($C_{eff}$) fracture length, fracture width, and fluid efficiency. The leak-off exponent (n) can be used with the fluid-loss coefficient to design any subsequent fracturing treatment for the particular fluid/formation system.

The preferred method for determining the leak-off exponent, n, is a graphical method using a plot of log δP, the pressure difference, versus log $G(\delta,\delta_o,n)$ for several values of n at selected values of $\delta_o$. Dimensionless reference times ($\delta_o$) of 0.25 and 1.0 are conventionally selected, but other values may be used also. The selected reference times are used in the $G(\delta,\delta_o,n)$ equations (Eqns. (6) and (7) and the ΔP equation below to define two lines. The leak-off exponent, as well as other fracture parameters, can be determined using the equation reproduced below:

$$\Delta P = P^* G(\delta,\delta_o,n) \qquad \text{EQN. (8)}$$

In this method, if n is the correct value, the plot of log ΔP v. log $G(\delta,\delta_o,n)$ for several values of $\delta_o$ yields one straight line with a slope equal to one. If n is incorrect, then several lines result for the different $\delta_o$ values. By changing the n value and observing whether the lines converge or diverge, the ocrrect value of n can be determined. leak-off exponent that yields the minimum separation of the lines on the plot is the leak-off exponent for the formation and fluid system.

Using the curve with the most correct n value, the match pressure (P*) is determined. The intercept of the straight line of the correct n value with the line where $G(\delta,\delta_o,n)$ equals 1yields P*. The leak-off exponent, n, is then used with the chosen fracture geometry model to further define the fracture and formation parameters.

The preferred method of determining the value of n in accordance with the present invention is illustrated below with computer simulated data. When ΔP is plotted versus several $G(\delta,\delta_o,n)$ with various exponents, a plot such as FIG. 5 is produced. From shapes of various curves, one may deduce the value of the exponent. The data for the correct leak-off exponent should join one straight line with unit slope. In FIG. 5 only one set of data gives a straight line with a unit slope, i.e., where the leak-off exponent n=1.0. Consequently, n equal to 0.50 and 0.75 are incorrect because the two curves diverge from a straight line. When the wrong leak-off exponent is used, a curve is formed for each reference dimensionless time and these curves will remain separated, as shown for n=0.50 and 0.75 in FIG. 5. The degree of separation increases as error in leak-off exponent increases. Consequently, graphs of a figure such as FIG. 5 are easily used to analyze fluid pressure data and to obtain confidence in the calculated leak-off exponent.

In another embodiment of the present invention, the leak-off exponent (n) can be determined by generating type curves that are the derivative of $G(\delta,\delta_o,n)$ versus dimensionless time (δ) for various leak-off exponents. Type curves generated in accordance with this embodiment are shown in FIG. 6. The collected field data are plotted as the derivative of ΔP versus dimensionless time. In this embodiment, the field data are matched to the type curves for the best fit to establish the correct n for the fluid/formation system.

Having determined P* using the correct leak-off exponent (n) the fluid-loss coefficient ($C_{eff}$) fracture length (L) fluid efficiency (η) and average fracture width ($\bar{w}$), can be calculated. The following equations illustrate the present methods as derived for the Perkins and Kern fracture geometry model:

Leak-off coefficient ($C_{eff}$) may be determined according to Eqn. (9) which is similar to Eqn. (4).

$$C_{eff} = \frac{P \cdot H^2 \beta_s}{H_p E' t_o^{1-n}} \qquad \text{EQN. (9)}$$

Fracture length may be determined according to the following equations:

$$L = \frac{q t_o}{\frac{2 C_{eff} H_p t_o^{1-n}}{(1-n)(2-n)} + \frac{\pi H^2}{2E'} \beta_p \rho} \quad (n \neq 1) \qquad \text{EQN. (10)}$$

$$L = \frac{q t_o}{2 C_{eff} H_p + \frac{\pi H^2}{2E'} \beta_p \rho} \quad (n = 1) \qquad \text{EQN. (11)}$$

Fluid efficiency may be determined from the following equations:

$$\eta = 1 - \frac{2}{(1-n)(2-n)} \frac{C_{eff} H_p L}{q (t_o)^n} \quad (n \neq 1) \qquad \text{EQN. (12)}$$

$$\eta = 1 - \frac{2 C_{eff} H_p L}{q t_o} \quad (n = 1) \qquad \text{EQN. (13)}$$

Once fracture length and fluid efficiency are determined average fracture width may be determined as follows:

$$w = \frac{2}{(1-n)(2-n)} C_{eff} \frac{H_p}{H} (t_o)^{1-n} \rho \quad (n \neq 1) \qquad \text{EQN. (14)}$$

$$w = 2 C_{eff} \frac{H_p}{H} \rho \quad (n = 1) \qquad \text{EQN. (15)}$$

$$\text{where } \rho = \frac{\eta}{1-\eta} \qquad \text{EQN. (16)}$$

The equations set forth above are derived for the Perkins and Kern fracture geometry model. Those skilled in the art will readily understand that the present invention is also applicable to the Khristianovic-Zheltov model, the radial model and other modifications to these fracture geometry models such as including the Biot Energy Equation as shown in U.S. Pat. No. 4,848,461.

Once the leak-off coefficient ($C_{eff}$) and the leak-off exponent (n) have been determined, the apparent leak-off velocity of a given point in the fracture may be determined from Eqn. (17)

$$v = \frac{C_{eff}}{(\Delta t)^n} \qquad \text{EQN. (17)}$$

In a preferred implementation of the method of the present invention, the type curve matching technique is used to determine match pressure (P*) and the remaining fracturing parameters, L,η, and $\bar{w}$. However, one can also determine the leak-off exponent (n) in accordance with the present invention and then use field observed closure times for determining the fracture geometry parameters. When using the field observed closure time methods, formation closure time is first determined. The pressure decline function (G) is determined using the correct leak-of exponent (n).

The following example is provided to illustrate the present invention, but is not intended to limit the invention in any way.

EXAMPLE

A two stage minifrac treatment was performed on an 8 ft coal seam at a depth of approximately 2,200 ft. Fresh water was injected at 30 bpm in two separate stages. For the second stage a total volume of 60,000 gallons was injected with 10 proppant stages. The well was shut-in, and the pressure decline due to fluid leak-off was monitored. In most analyses of pressure decline using type curve functions, it is usually convenient that the time interval between well shut-in and fracture closure be at least twice the pumping time, and this condition was followed. The injection time for the second stage was 48.5 min., and fracture closure occurred 108 min. after shut-in. The measured pressure decline vs. shut-in time is shown in FIG. 7.

A log-log plot of the measured pressure difference vs. dimensionless time for various reference times was created and is shown in FIG. 8. The graph of FIG. 8 was matched with the new type curves developed in accordance with the present invention and leak-off exponent $n=1.0$. This indicates that the leak-off rate is inversely proportional to time. The match of the curve in FIG. 8 with the new type curves is almost exact and yields a match pressure (P*) of 105.4 psi. These field data did not match well with the conventional type curve, i.e., $n=0.50$. However, if a match is forced, an erroneous P* is observed and as discussed above, problems with designing the full scale fracture treatment would result.

The curves in FIG. 9 demonstrate a preferred method for generating the type curves of the present invention for analyzing heterogeneous formations. FIG. 9 is a plot of the log of pressure difference vs. log of dimensionless pressure function for leak-off exponents of 0.5, 0.75, and 1.00 at reference times of 0.25 and 1.00. The lines generated for the dimensionless pressure function $G(\delta,\delta_o,n)$ where the leak-off exponent, $n=0.50$, (i.e., representation for conventional, homogeneous formation) were separate and had distinctly different slopes. The slope for $\delta_o=0.25$ is slightly less than 1.0 and the slope for $\delta_o=1.00$is slightly greater than 1.0. FIG. 9 shows the lines for $n=0.75$ to be closer together than for $n=0.5$. However, the lines for the dimensionless pressure function having the leak-off exponent $n=1.00$ converged in the early part of shut-in and overlapped until closure. The slope of the joined straight line was 1.0 which indicates that the leak-off exponent for this case is 1.0.

What is claimed is:

1. A method of determining the parameters of a full scale fracturing treatment of a subterranean formation comprising the steps of:
   (a) injecting fluid into a wellbore penetrating said subterranean formation to generate a fracture in said formation;
   (b) measuring the pressure of the fluid in said fracture over time;
   (c) determining a leak-off exponent that characterizes the rate at which said fluid leaks off into said formation as a function of time from step (b);
   (d) determining parameters of a fracturing treatment including fracture length and width using said leak-off exponent.

2. A method of determining the parameters of a full scale fracturing treatment of a subterranean formation comprising the steps of:
   (a) injecting a fluid into a wellbore penetrating said subterranean formation to generate a fracture in said formation;
   (b) measuring the pressure of the fluid in said fracture over time wherein said pressure changes after termination of said fluid injection;
   (c) determining a leak-off exponent which is characteristic of said formation from the change in pressure determined in step (b);
   (d) calculating the effective fluid-loss coefficient which is representative of the fluid lost during the full scale fracture treatment; and
   (e) determining the fracture length, fluid efficiency, and fracture width for designing the full scale fracture treatment.

3. The method of claim 2 wherein said leak-off exponent is determined by curve matching of field data to idealized type curves defined by the equations:

$$G(\delta,\delta_o,n) = \frac{4}{\pi}\ \frac{1}{(1-n)(2-n)}\ [(1+\delta)^{2-n} - \delta^{2-n} - (1+\delta_o)^{2-n} + \delta_o^{2-n}]$$

where the leak-off exponent, n, is not equal to 1; and $$G(\delta,\delta_o,n) = \frac{4}{\pi}\left[\delta\ln\left(\frac{1+\delta}{\delta}\right) + \ln(1+\delta) - \delta_o\ln\left(\frac{1+\delta_o}{\delta_o}\right) - \ln(1+\delta_o)\right]$$

where the leak-off exponent, n, is equal to 1.

4. The method of claim 2 wherein said leak-off exponent (n) is determined by plotting the logarithm of the pressure difference versus the logarithm of the pressure decline function (G) wherein the plot of n for several values of dimensionless reference time form one straight line with a unit slope.

5. The method of claim 2 wherein said leak-off exponent is determined by type curve matching of field data represented by a graph of the derivative of the pressure difference versus dimensionless time with a graph of the derivative of the pressure decline, $G(\delta,\delta_o,n)$, versus dimensionless time.

6. A method for determining the fluid-loss characteristics of a fracturing fluid in a heterogeneous formation comprising the steps of:
   (a) injecting fluid into a wellbore penetrating said formation at a rate and pressure sufficient to generate a fracture in said formation;
   (b) measuring the pressure of the fluid in said fracture over time wherein said pressure changes after fluid injection;
   (c) producing type curves for a leak-off exponent (n) ranging from 0.00 to 1.0;
   (d) representing the pressure data collected in step (b) as logarithm of the pressure difference versus logarithm of dimensionless time;
   (e) matching the data of step (d) to the curves of step (c) to determine the appropriate exponent that characterizes the naturally fractured formation;
   (f) determining the match pressure from step (e); and
   (g) calculating the fluid-loss coefficient.

7. The method of claim 6, wherein the type curves of step (c) are characterized by the equations:

$$G(\delta,\delta_o,n) = \frac{4}{\pi}\ \frac{1}{(1-n)(2-n)}\ [(1+\delta)^{2-n} -$$

-continued $$\delta^{2-n} - (1 + \delta_o)^{2-n} + \delta_o^{2-n}]$$

where the leak-off exponent (n) is not equal to 1; and $$G(\delta,\delta_o,n) = \frac{4}{\pi}\left[\delta\ln\left(\frac{1+\delta}{\delta}\right) + \ln(1+\delta) - \delta_o\ln\left(\frac{1+\delta_o}{\delta_o}\right) - \ln(1+\delta_o)\right]$$

where the leak-off exponent (n) is equal to 1.

* * * * *